US006227175B1

(12) United States Patent
Jiang et al.

(10) Patent No.: US 6,227,175 B1
(45) Date of Patent: May 8, 2001

(54) FUEL INJECTOR ASSEMBLY HAVING A COMBINED INITIAL INJECTION AND A PEAK INJECTION PRESSURE REGULATOR

(75) Inventors: He Jiang, Canton; Craig L. Savonen, Carleton, both of MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/472,416

(22) Filed: Dec. 27, 1999

(51) Int. Cl.[7] ..... F02M 37/04
(52) U.S. Cl. ..... 123/496
(58) Field of Search ..... 123/496, 446, 123/500, 501, 506, 299–300

(56) References Cited

U.S. PATENT DOCUMENTS 5,094,215 * 3/1992 Gustafson ..... 123/500
5,463,996 * 11/1995 Maley et al. ..... 123/446
5,492,098 * 2/1996 Hafner et al. ..... 123/446
5,535,723 * 7/1996 Gibson et al. ..... 123/446
5,551,398 * 9/1996 Gibson et al. ..... 123/446
5,628,293 * 5/1997 Gibson et al. ..... 123/446
6,113,000 * 9/2000 Tian ..... 239/88

* cited by examiner

*Primary Examiner*—Thomas N. Moulis
(74) *Attorney, Agent, or Firm*—Bill C Panagos

(57) ABSTRACT

A fuel injector assembly for an internal combustion engine including an injector body in fluid communication with a source of fuel and a nozzle assembly through which the fuel is dispersed from the fuel injector assembly during an injection event. A high pressure fuel delivery system provides high pressure fuel to the nozzle assembly. In addition, the fuel injector assembly includes a combined initial injection and peak injection pressure regulator which is operable to control the nozzle assembly to regulate the rate of fuel injection at the beginning of an injection event and is further operable to limit the maximum pressure of the fuel dispersed from the nozzle assembly.

17 Claims, 7 Drawing Sheets

FUEL INJECTOR ASSEMBLY HAVING A COMBINED INITIAL INJECTION AND A PEAK INJECTION PRESSURE REGULATOR

BACKGROUND OF THE INVENTION

1. Field of the Invention

The present invention relates, generally, to fuel injector assemblies for internal combustion engines. More specifically, the present invention relates to such a fuel injector having a combined initial injection and peak injection pressure regulator.

2. Description of the Related Art

Fuel injector assemblies are employed in internal combustion engines for delivering a predetermined, metered mixture of fuel to the combustion chamber at preselected intervals. Fuel injectors commonly employed in the related art typically include a high pressure fuel passage which extends between a solenoid actuated control valve and a cylindrical bore formed in the injector body. A plunger is reciprocated within the cylindrical bore to increase the pressure of the fuel. Fuel at relatively low pressure is supplied to the fuel inlet port when plunger at its top dead center. The control valve meters the delivery of the fuel at predetermined intervals through a fuel passage to the fuel spilling port. Fuel at very high pressures is delivered to a fuel nozzle assembly and ultimately dispersed from the injector.

In the case of compression ignition or diesel engines, the fuel is delivered at relatively high pressures. Presently, conventional injectors are delivering fuel at pressures as high as 32,000 psi. These are fairly high pressures and have required considerable engineering attention to ensure the structural integrity of the injector, good sealing properties and the effective atomization of the fuel within the combustion chamber. In essence, the modern diesel engine must provide substantial fuel economy advantages while meeting ever more stringent emission regulations. However, increasing demands for greater fuel economy, cleaner burning, fewer emissions and $NO_x$ control have placed, and will continue to place, even higher demands on the engine's fuel delivery system, including increasing the fuel pressure within the injector.

In part to meet the challenges discussed above, electronic control modules have been employed to control the beginning and end of the fuel injection event, injection timing and fuel quantity, to improve fuel economy and meet emission requirements. Still, there is an ongoing need in the art for better control over additional injection parameters, such as the rate of fuel injection and peak injection pressures over the span of the injection event in a cost effective manner.

The fuel injection rate with respect to time of a conventional fuel injector is naturally a trapezoid shape having a relatively linear build-up from a low initial rate to a high rate near the end of injection. A low initial rate of injection tends to yield low $NO_x$ emissions. A high rate of injection late in the event tends to yield low particulate emission and better fuel economy.

One of the ways to lower $NO_x$ emissions and otherwise meet emission requirements is to regulate initial fuel injection rates to a lower level so that the maximum combustion temperature and, therefore, $NO_x$ formation is reduced. A short initial injection of fuel, commonly known as a pilot injection, at the beginning of the injection event has also been employed for this purpose. However, attempts to regulate the fuel injection rate at the beginning of the injection event and/or to provide pilot injections of fuel known in the related art generally suffer from the disadvantage that they are mechanically complex, require complex electronic control are only marginally effective and/or are otherwise expensive.

On the other hand, to address fuel consumption issues and improve fuel economy, it is desirable to improve the fuel spray quality. This may be accomplished by increasing the fuel injection pressure, especially at peak torque and part load. In turn, increasing injection pressure can be achieved by using an injector cam with a high velocity profile or by specifying a larger plunger diameter. However, the cam profile, plunger diameter, or other hardware configurations which provide higher injection pressures at mid-speed and mid-load usually generate extremely high injection pressures at high engine speed and high load. Such elevated injection pressures may cause serious injector reliability and durability problems. Accordingly, it is known in the related art to employ relief valves which act to limit peak system pressure. However, there remains a need in the art for a fuel injector assembly having systems which may be employed to lower the initial rate of fuel injection and to limit peak injection pressure in a simple, inexpensive and cost-effective manner.

SUMMARY OF THE INVENTION

The present invention overcomes the disadvantages in the related art in a fuel injector assembly for an internal combustion engine including an injector body in fluid communication with a source of fuel. The assembly further includes a nozzle assembly through which fuel is dispersed during an injection event. A high pressure fuel delivery system provides high pressure fuel to the nozzle assembly. In addition, the fuel injector assembly includes a combined initial injection and peak injection pressure regulator which is operable to control the nozzle assembly so as to regulate the rate of fuel injection at the beginning of an injection event and further operable to limit the maximum pressure of the fuel dispersed from the nozzle assembly.

Accordingly, one advantage of the present invention is that the combined initial injection and peak injection pressure regulator is operable to provide for an initial, pilot injection and/or reduce the initial rate of fuel injection.

Another advantage of the present invention is that the combined initial injection and peak injection pressure regulator can be tuned such that various combinations of initial injection rate can be created thereby lowering the maximum combustion temperature and lowering $NO_x$ emissions.

Another advantage of the present invention is that the combined initial injection and peak injection pressure regulator is further operable to limit the maximum pressure of the fuel dispersed from the nozzle assembly. Thus, the combined initial injection and peak injection pressure regulator is especially adapted for use in conjunction with injectors where high injection pressures are desired at low engine speed and load.

Another advantage of the present invention is that the combined initial injection and peak injection pressure regulator effectively addresses the issue of liability and durability in fuel injection environments involving high injection pressures.

Still another advantage of the present invention is that the above-identified features are provided in a combined initial injection and peak injection regulator which is simple, cost-effective and efficient in operation and which is also elegantly simple and not overly mechanically complex.

Other objects, features and advantages of the present invention will be readily appreciated as the same becomes better understood after reading the subsequent description taken in connection with the accompanying drawings.

DETAILED DESCRIPTION OF THE PREFERRED EMBODIMENT(S)

Figure 5:
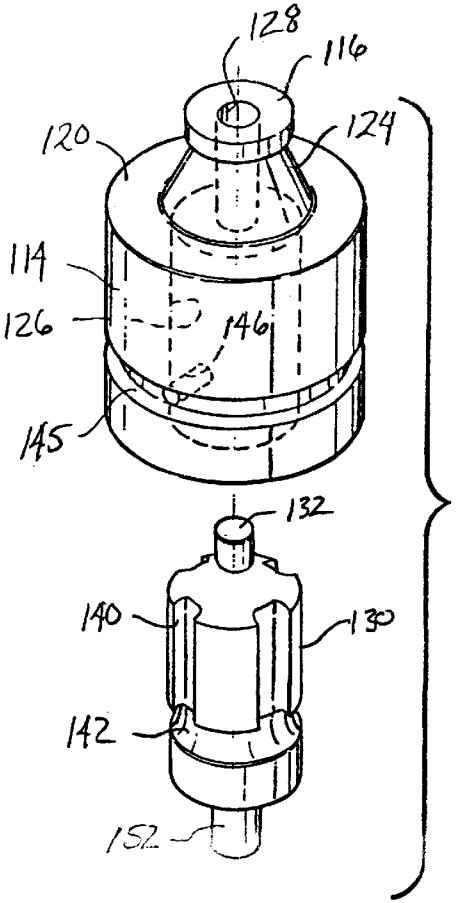
FIG. 5 is an exploded view illustrating the rate shaping valve member and waste gate valve member of the present invention.
Figure 1:
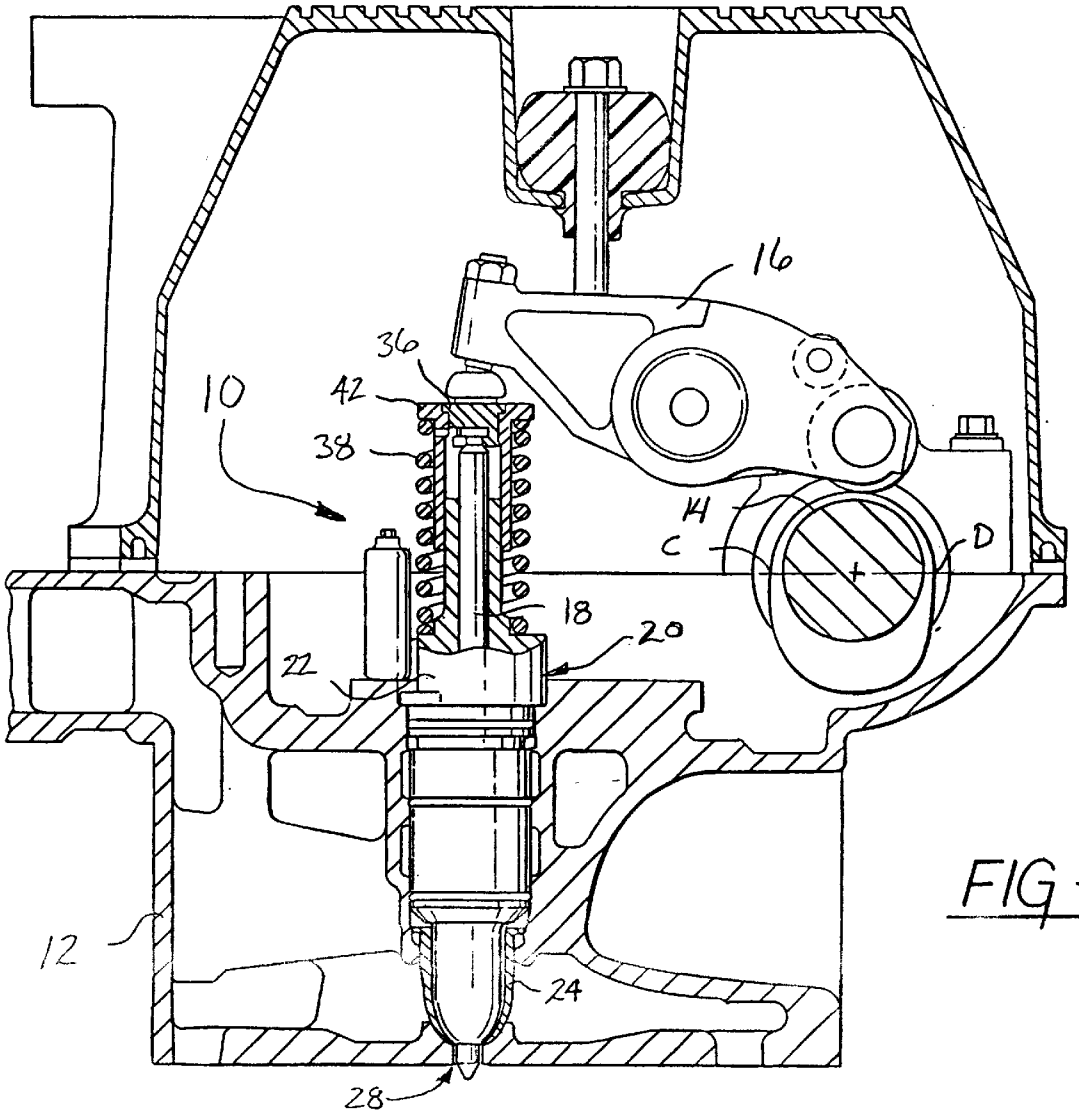
FIG. 1 is a cross-sectional side view of a fuel injector supported in a cylinder head and actuated by cam driven rocker arms.

Referring now to the figures, where like numerals are used to designate like structure throughout the drawings, a fuel injector assembly for an internal combustion engine is generally indicated at 10 in FIG. 1. The injector assembly 10 is shown in a typical environment supported by a cylinder head 12 and adapted to inject fuel into a cylinder of an internal combustion engine. The fuel is combusted to generate power to rotate a crankshaft. A cam 14 is rotated to drive a rocker arm 16, which in turn, actuates a plunger 18 supported for reciprocation by the injector assembly 10. Alternatively, an engine driven cam may be employed to actuate the plunger 18 directly as is commonly known in the art. Movement of the plunger 18 acts to increase the fuel pressure within the injector assembly 10. Fuel is ultimately injected by the assembly 10 into a cylinder at high pressure as will be described in greater detail below.

Figure 2:
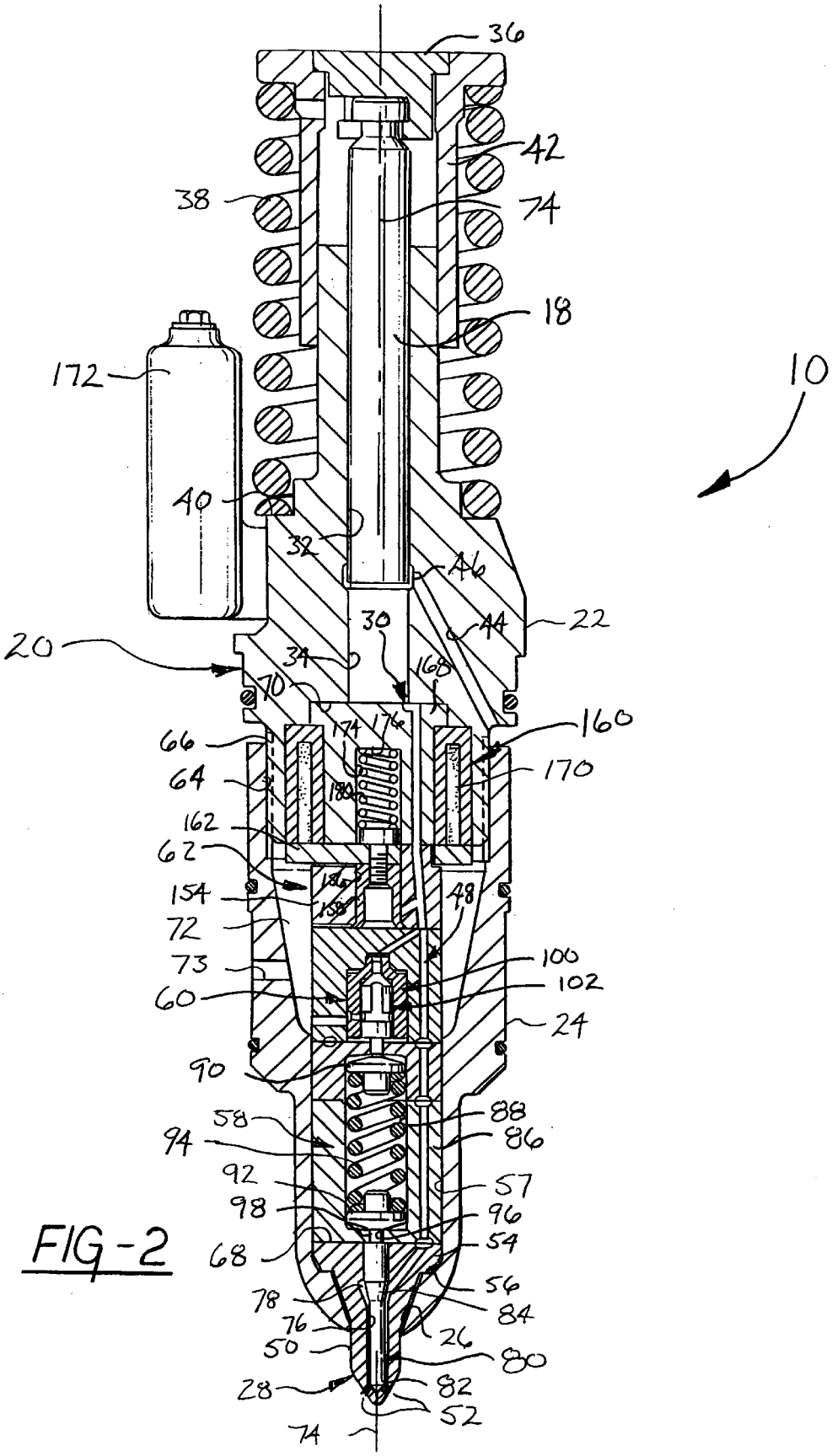
FIG. 2 is a cross-sectional side view of the fuel injector assembly of the present invention.

Referring now to FIG. 2, a fuel injector assembly 10 according to the present invention is shown in cross-section and includes a vertically extending injector body, generally indicated at 20, in fluid communication with a source of fuel. The injector body 20 includes a bushing 22 and a nut 24 threaded to the lower end of the bushing 22 and which forms an extension thereof. The nut 24 has an opening 26 at its lower end through which extends the lower end of a nozzle assembly, generally indicated at 28. Fuel is dispersed from the nozzle assembly 28 during an injection event as will be described in greater detail below.

The injector assembly 10 also includes a high pressure fuel delivery system, generally indicated at 30, which serves to provide fuel at high pressure to the nozzle assembly 28. Thus, the high pressure fuel delivery system 30 includes a cylindrical bore 32 formed in the bushing 22. The plunger 18 is slidably received by the cylindrical bore 32. Together, the plunger 18 and cylindrical bore 32 define a pump chamber 34. The plunger 18 extends out one end of the bushing 22 and is topped by a cam follower 36. A return spring 38 supported between a should 40 formed on the bushing 22 and a plunger spring retainer 42 serve to bias the plunger 18 to its fully extended position. A stop hook (not shown) extends through an upper portion of the injector body 20 to spring retainer 42 to limit upward travel of the plunger 18 induced under the bias of the return spring 38.

Low pressure fuel is supplied to the assembly 10 from a fuel rail or the like through a fuel feed passage 44 formed in the bushing 22. The fuel feed passage 44 communicates with the pump chamber 34 via an inlet port 46. On the other hand, the high pressure fuel delivery system 30 further includes a high pressure fuel passage, generally indicated at 48, which extends through the injector body 20 from the pump chamber 34 to the nozzle assembly 28.

The nozzle assembly 28 includes a spray tip 50 having at least one, but preferably a plurality of, apertures 52 through which fluid is dispersed from the assembly 28. The spray tip 50 is enlarged at its upper end to provide a shoulder 54 which seats on an internal shoulder 56 provided by the through counter-bore 57 in the nut 24. Between the spray tip 50 and the lower end of the injector body 20, there is positioned above the nozzle assembly 28, in sequence starting from the spray tip 50, a biasing member, generally indicated at 58, a combined initial injection and peak injection pressure regulator, generally indicated at 60 and a solenoid operated check valve generally indicated at 62. As illustrated in these figures, these elements are formed as separate parts for ease of manufacturing and assembly. The nut 24 is provided with internal threads 64 for mating engagement with the internal threads 66 at the lower end of the injector body 20. The threaded connection of the nut 24 to the injector body 20 holds the spray tip 50, biasing member 58, pressure regulator 60 and solenoid operated check valve 62 clamped and stacked end to end between the upper face 68 of the spray tip 50 and the bottom face 70 of the bushing 22. All of these above-described elements have lapped mating surfaces whereby they are held in pressure sealed relation to each other.

The injector body 20 has a longitudinal axis 74 which defines the centerline thereof. The plunger 18, pressure regulator 60, check valve 62 and nozzle assembly 28 are each disposed axially along this centerline. In addition, the nut 24 defines a low pressure fuel spill gallery 72 in which unused fuel is collected from the fuel delivery system 30. Fuel exits the injector body 20 via fuel return port 73 formed in the nut 24 adjacent the spill gallery 72. The spill gallery 72 and the high pressure fuel passage 48 are laterally spaced from, and specifically located on, opposite sides of the centerline within the injector body 20.

The nozzle assembly 28 includes a nozzle bore 76 formed in the spring tip 50 along the centerline of the injector body 20. The bore 76 is in fluid communication with the high pressure fuel passage 48 and defines an injection cavity 78. The nozzle assembly 28 also includes a needle valve, generally indicated at 80 which is movably supported within the nozzle bore 76 in response to fuel pressure between a closed position, wherein no fuel is dispersed from the nozzle assembly 28 and an open position wherein fuel is dispersed from the nozzle tip 50 through the aperture 52 when the pressure in the nozzle bore exceeds a predetermined needle opening pressure. Accordingly, the needle valve 80 has a tip portion 82 and a valve portion 84 which is complementarily received within the injection cavity 78. The tip portion 82 is adapted to close the apertures 52 when the pressure in the fuel delivery system 30 is below the needle closing pressure. On the other hand, the needle valve 80 is responsive to the pressure acting on the valve portion 84 within the injection cavity 78 to move to its open position, thereby dispersing fuel from the injector 10 through the apertures 52. The biasing member 58 biases the needle valve 80 to its closed position with a predetermined force such that the needle valve 80 moves to its open position only after the pressure from the fuel delivery system 30 acting within the injector cavity 78 has reached a needle opening pressure.

The biasing member 58 includes a spring cage 86 supported at one end in abutting contact with the upper face 68 of the spray tip 50. The spring cage 86 has a spring chamber 88 formed therein. Within the spring chamber 88 there is an upper retainer 90 and a lower retainer 92, spaced apart from one another. A coiled spring 94 extends between the two retainers 90, 92 so as to bias them in opposite directions with a predetermined force. The spring cage 86 includes a lower aperture 96 corresponding to the lower retainer 92 and extending between the spring chamber 88 and the nozzle bore 76. The needle valve 80 also includes a head 98 which is disposed opposite the tip portion 82. The head 98 is received through the lower aperture 96 and is engaged by the lower retainer 92. Thus, the lower retainer 92 translates the predetermine force to the needle valve 80 to bias it to its closed position.

As noted above, the combined initial injection and peak injection pressure regulator 60 is disposed immediately above the biasing member 58. The combined initial injection and peak injection pressure regulator 60 is operable to control the nozzle assembly 28 to regulate the rate of fuel injection at the beginning of an injection event. In addition, the pressure regulator 60 is also operable to limit the maximum pressure of the fuel dispersed from the nozzle assembly 28. To that end, the injection pressure regulator 60 is movably supported between a closed position and two open positions: (1) a first open position which reduces the rate of fuel injection at the beginning of the injection event; as well as (2) a second open position which limits the maximum pressure of the fuel dispersed by the nozzle assembly 28. The pressure regulator 60 is also adapted to provide a short burst of pilot fuel injected at the beginning of the injection event when it is moved to the first open position as will be explained in greater detail below. The biasing member 58 biases the injection pressure regulator 60 to its closed position with a predetermined force such that the injection pressure regulator 60 moves to its first open position only after the pressure in the fuel delivery system 30 has reached a predetermined first opening pressure. Furthermore, the biasing member 58 acts such that the injection pressure regulator 60 moves to its second open position only after the pressure in the fuel delivery system 30 has reached a predetermined second opening pressure.

Figure 3:
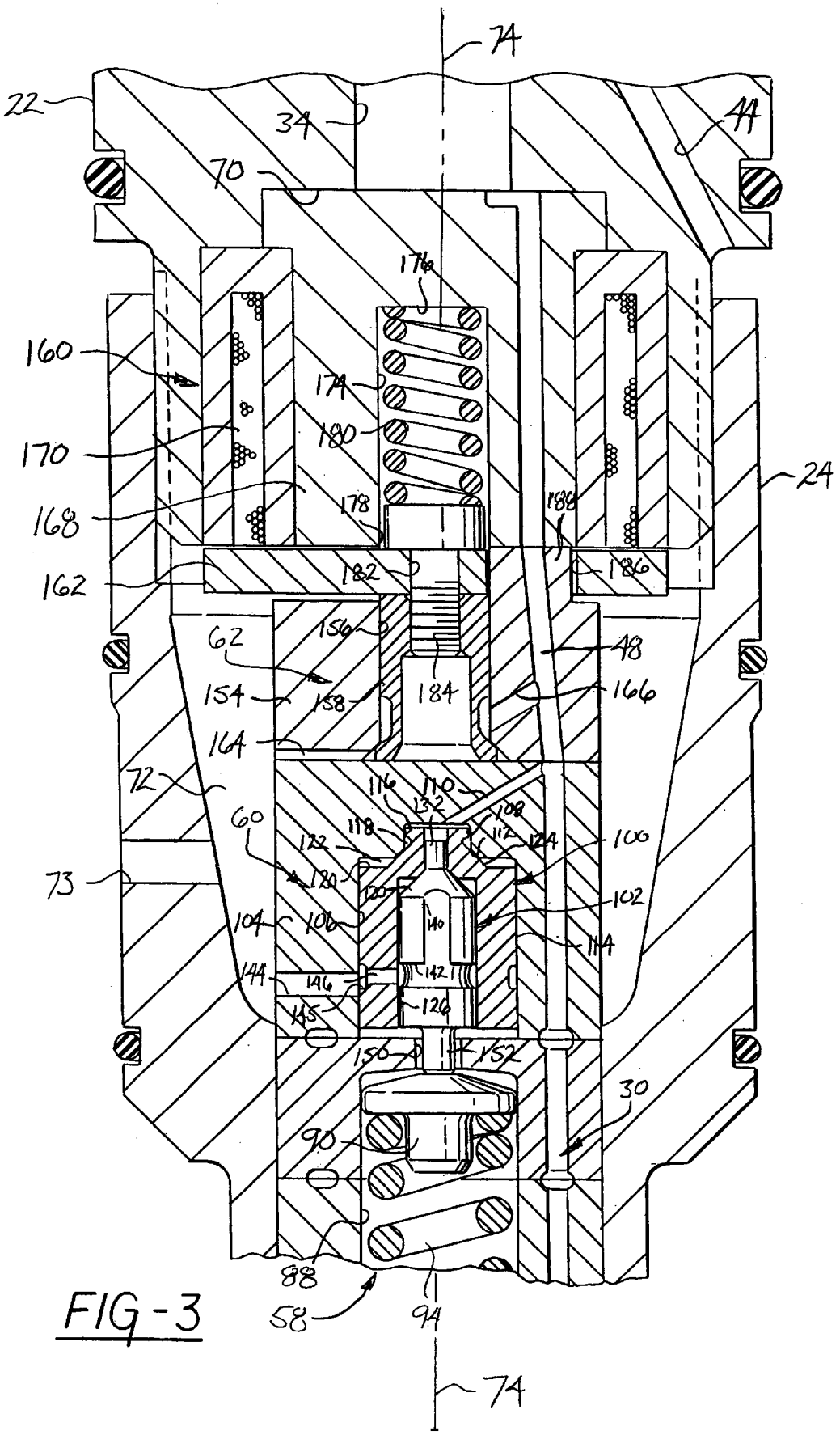
FIG. 3 is an enlarged, partial cross-sectional side view of the fuel injector illustrating the combined initial injection and peak injection pressure regulator of the present invention.
Figure 4:
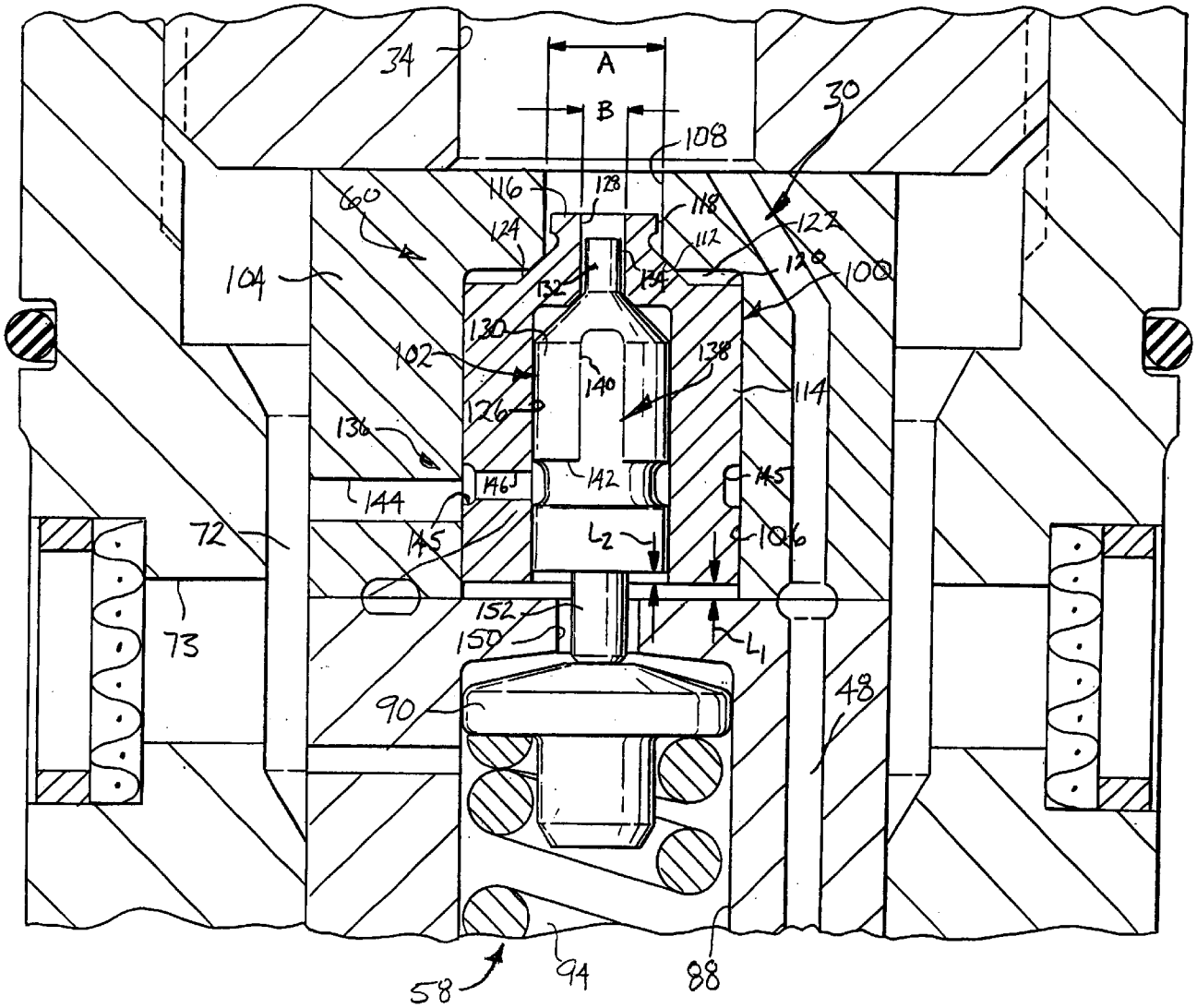
FIG. 4 is an enlarged, partial cross-sectional side view of an alternate embodiment of a fuel injector employing the combined initial injection and peak injection pressure regulator of the present invention.

Referring now to FIGS. 3 through 7, the combined initial injection and peak injection pressure regulator 60 includes a rate shaping valve, generally indicated at 100 and a waste gate valve, generally indicated at 102. The injection pressure regulator 60 includes a housing 104 having a valve bore 106 defining a first, larger diameter and an inlet 108 defining a second, smaller diameter labeled "A" in FIG. 4. The inlet 108 provides fluid communication between the fuel delivery system 30 and the valve bore 106 via a short conduit 110. Alternatively, and as shown in FIG. 4, the inlet 108 may be in direct fluid communication with the pump chamber 34. In this embodiment, the check valve 62 is located elsewhere on the injector body. Otherwise, the fuel injector assembly 10 illustrated in FIG. 4 is substantially identical in all important respects to that illustrated in FIGS. 2 and 3. The housing 104 also includes a valve seat 112 which is defined between the inlet 108 and the valve bore 106.

The rate shaping valve 100 includes a precision machined cylindrical body 114 complementarily received within the valve bore 106 to prevent any leakage of pressurized fluid between the body 114 and the bore 106. The rate shaping valve 100 also includes a pintle head 116 extending from the body 114 and which is adapted to be received in the inlet 108 so as to define a predetermined annual clearance 118 therebetween. Thus, the annular clearance 118 is formed by the dimensional difference between the diameter "A" of the inlet 108 and the diameter of the pintle head 116. In addition, an annular shoulder 120 is formed between the body 114 and the pintle head 116. A valve chamber 122 is defined between the annular shoulder 120 and the valve bore 106. The rate shaping valve 100 also includes a frusto-conical portion 124 formed between the pintle head 116 and the annular shoulder 120 which cooperates with the valve seat 112.

The rate shaping valve 100 is movably supported within the valve bore 106 from a closed position to an open position in response to fuel pressure in the fuel delivery system 30 acting on the pintle head 116. In its open position, fuel flows past the pintle head 116 and the frusto-conical portion 124, through the annular clearance 118 and into the valve chamber 122. This reduces the rate of fuel dispersed from the nozzle assembly 28 by reducing the pressure of the fuel at the beginning of the injection event.

The rate shaping valve 100 may also be configured to provide a short pilot injection of fuel into the cylinder. In the case of a pilot injection, the needle valve 80 initially opens to allow a short pre-injection of fuel. The annular clearance 118 is of sufficient size that fuel flow into the valve chamber 122 reduces the system fuel pressure such that it falls below the needle opening pressure. The needle valve 80 is then closed until the fuel pressure in the delivery system 30 again rises above the needle opening pressure. However, the rate shaping valve 100 remains in its open position because the pressure required to keep it open (i.e., system pressure acting on both the pintle head 116 and the shoulder 120) is less than required to move it to its open position (i.e., the pressure acting on the pintle head 116 alone). In either event, the rate shaping valve functions to reduce the maximum combustion temperature and thus $NO_x$ formation. The biasing member 58 biases the rate shaping valve 100 to its closed position with a predetermined force such that the rate shaping valve 100 moves to its open position only after the pressure in the fuel delivery system 30 has reached a predetermined rate shape valve opening pressure.

As best shown in FIGS. 4 through 7, the body 114 of the rate shaping valve 100 also serves as a housing for the waste gate valve 102. Accordingly, this housing 114 has a waste valve bore 126 which defines a first, larger diameter. In addition, the waste gate housing 114 includes an inlet 128 defining a second, smaller diameter labeled "B" in FIG. 4.

The waste gate valve 102 includes a precision machined, substantially cylindrical body 130 complementarily received within the waste valve bore 126 and a pintle head 132 which is adapted to be received within the inlet 128 so as to define a predetermined annular clearance 134 therebetween. Thus, the annular clearance 134 is formed by the dimensional difference between the diameter "B" of the inlet 128 and the diameter of the pintle head 132. In addition, a waste fuel passage system, generally indicated at 136, provides fluid communication between the waste valve bore 126 and the fuel spill gallery 72. More specifically, the waste fuel passage system 136 includes grooved passages 138 formed on the waste gate valve body 130. The grooved passages 138 include a plurality of flow grooves 140 spaced circumferentially from one another about the waste gate valve body 130 and which extend axially along a portion thereof. The grooved passages 138 also include a belt groove 142 which is disposed annularly about the circumference of the waste body 130.

The waste fuel passage system 136 also includes at least one connecting passage 144 which extends through the injection pressure regulator housing 104 and provides fluid communication between the fuel spill gallery 72 and the rate shaping valve bore 106. In addition, at least one, but preferably a plurality of, shunt passages 146 extends through the waste gate housing 114 and correspond to an annular groove 145 formed about the lower portion of the rate shaping valve body 114. The annular groove 145 corresponds to the connecting passage 144 thereby providing fluid communication between the connecting passage 144 and the shunt passages 146. The belt groove 142 establishes fluid communication between the shunt passage 146 and the flow grooves 140.

As noted above, the biasing member 58 biases the injection pressure regulator 60 to its closed position. To this end, the upper spring retainer 90 translates a predetermined force to the injection pressure regulator 60 though the waste gate valve 102 to bias the regulator 60 to its closed position. More specifically, the spring chamber 88 includes an upper aperture 150 which corresponds to the upper retainer 90 and extends between the spring chamber 88 and the waste valve bore 126. The waste gate valve body 130 includes a tail 152 received through the upper aperture 150 and which is engaged by the upper retainer 90 to bias the waste gate valve 102 and, ultimately, the combined initial injection and peak injection pressure regulator 60 to its closed position.

The inlet 128 provides fluid communication between the fuel delivery system 30 and the waste valve bore 126. The waste gate valve 102 is co-axial relative to the rate shaping valve 100 as well as the axis 74 of the injector assembly 10. Further, the waste gate valve 102 is movably supported within the waste valve bore 126 (i.e. within the rate shaping valve body 114) from a closed position to an open position in response to fuel pressure in the fuel delivery system 30. In its open position, the waste gate valve 102 provides fluid communication between the fuel delivery system 30 and the fuel spill gallery 72. When the waste gate valve 102 is open, the fuel pressure in the fuel delivery system 30 is dramatically reduced. The waste gate valve 102 therefore serves to limit the peak pressure in the fuel delivery system 30 and thus the peak injection pressure. The peak system and injection pressures can be engineered by controlling the size of the inlet 128 of the waste gate valve 102. The larger the inlet 128, the lower the peak system and injection pressures of the injector assembly 10.

In the embodiments disclosed herein, a single biasing member 58 is employed to bias both the needle valve 80 to its closed position as well as bias the combined initial injection and peak injection pressure regulator 60 (i.e., both the rate shaping valve 100 and the waste gate valve 102) to its closed position. However, those having ordinary skill in the art will appreciate that one biasing member may be employed and dedicated to the needle valve 80 while a separate biasing member may be dedicated to bias the pressure regulator 60. Additionally, separate biasing members may be used for each of the rate shaping valve 100 and waste gate valve 102.

As shown in FIGS. 2 and 3, the solenoid operated check valve 62 may be located between the pump chamber 34 and the nozzle assembly 28 and between the low pressure fuel spill gallery 72 and the high pressure fuel passage 48. More specifically, the check valve 62 may be located just above the combined initial injection and peak injection pressure regulator 60 and beneath the pump chamber 34. The check valve 62 is operable to control the pressure in the fuel delivery system 30. To this end, the check valve 62 is movable between an open position, wherein fluid communication is established between the high pressure fuel passage 48 and the low pressure spill gallery 72 thereby reducing the pressure in the fuel delivery system 30 to a closed position interrupting communication between the high pressure fuel passage 48 and the low pressure spill gallery 72 thereby increasing the pressure in the fuel delivery system 30. Closure of the check valve 62 and increasing the pressure in the fuel delivery system 30 facilitates the delivery of fuel at high pressure from the pump chamber 34 to the nozzle assembly 28.

The check valve 62 includes a valve housing 154 having a valve bore 156 and a valve member 158 movably supported therein. A solenoid assembly, generally indicated at 160, is mounted adjacent the housing 154. An armature 162 electromagnetically interconnects the valve 158 and the solenoid assembly 160 and acts to move the valve 158 between its open and closed positions. A very short conduit 164 extends within the housing 154 between the valve bore 156 and the fuel spill gallery 72. In addition, a connecting port 166 extends within the housing 154 between the valve bore 156 and the high pressure fuel passage 48.

The solenoid assembly 160 includes a pole piece 168 and a coil 170 wound about the pole piece 168. The coil 170 is electrically connected to a terminal 172 (shown in FIG. 2) which, in turn, is connected to a source of electrical power via a fuel injection electronic control module. The pole piece 168 includes a bore 174 having a blind end 176 and an air gap 178 which faces the armature 162. A coiled spring 180 is captured within the bore 174 and between the blind end 176 and the armature 162 to bias the valve 158 to its normally opened position. The armature 162 includes an opening 182 which is aligned with the bore 174 in the pole piece 168. A fastener 184 extends through the opening 182 and interconnects the armature 162 with the valve 158. The valve 158 is moved upwardly as viewed in the figures and the check valve 62 is closed when the coil 170 is energized to generate a magnetic flux which acts on the armature 162.

In the embodiment illustrated in FIGS. 2 and 3, the valve housing 154 includes a stepped portion 188 loosely received in the channel 186 so as to accommodate movement of the armature 182 but adapted for sealed abutting contact with the pole piece 168. Thus, the high pressure fuel passage 48 may extend through the pole piece 168 and the valve housing 154 through the stepped portion 188.

Operation

In operation, low pressure fuel is supplied to the assembly 10 from a fuel rail or the like through the fuel feed passage 44. Fuel enters the pump chamber 34 via the inlet port 46 when the plunger 18 is at its fully extended or rest position under the biasing influence of the return spring 38 as shown in FIG. 2. As illustrated in FIG. 1, the cam 14 is designed so that the duration of its total lift section (between points C and D) is about 180☜ of turning angle. The plunger 18 is driven downward by the cam lobe via the rocker arm 16 from its rest position to its maximum lift (or lowest position) and then back to the rest position in the first half turn of cam rotation. The plunger 18 stays at its top, rest position for the remaining half turn of cam rotation.

When the cam 14 rotates such that the lobe actuates the rocker arm 16, the plunger 18 is driven downward and the inlet port 46 is closed by the plunger 18. Downward movement of the plunger 18 increases the pressure in the fuel delivery system 30 to a maximum at maximum plunger lift.

The solenoid operated check valve 62 is normally held in its open position with the valve member 158 unseated under the biasing influence of the coiled spring 180. In this disposition, the fuel delivery system 30 is in fluid communication with the low pressure fuel spill gallery 72 via the short connecting port 166 and short conduit 164. Accordingly, the fuel delivery system 30 is vented to the low pressure side and high injection pressures cannot be developed in the injector.

However, the operation of the check valve 62 is controlled by an engine control module or some other control device. More specifically, during the downward stroke of the plunger 18, the solenoid assembly 160 may be powered to generate an electromagnetic force. The force attracts the armature 162 toward the solenoid assembly 160 which, in turn, moves the valve member 158 against the biasing force of the spring 180 to its closed position thereby interrupting communication between the fuel delivery system 30 and the fuel spill gallery 72 via the check valve 62. The fuel delivery system 30 is then pressurized by the pumping action of the plunger 18 during its downward stroke.

The combined initial injection and peak injection pressure regulator 60 is normally closed by the biasing force of the coiled spring 94 acting through the tail 152 of the waste gate valve 102. However, the rate shaping valve 100 is responsive to the pressure in the fuel delivery system 30 acting over the area "A" of the inlet 108.

Similarly, the nozzle assembly 28 is normally closed by the biasing force of the coiled spring 94 acting through the head 98 of the needle valve 80. The needle valve 80 is responsive to system pressure acting in the injection cavity 78 against the valve portion 84 to move the needle valve 80 to its open position. The fuel injection event then begins.

When the system pressure exceeds the rate shaping valve opening pressure, the rate shaping valve body 114 moves within the bore 106 against the biasing force of the coiled spring 94 to its open position over a distance "$L_1$" as noted in FIG. 4. Accordingly, the rate shaping valve opening pressure is defined by the area "A" of the inlet 108 and the preload of the spring 94. When the rate shaping valve 100 is open, pressurized fluid then flows from the inlet 108 into the valve chamber 122. The rate of fuel flow to the valve chamber 122 is determined by the cross-sectional area of the annular clearance 118 defined between the inlet 108 and the pintle head 116. A larger annular clearance 118 causes a greater amount of pressurized fluid to flow rapidly into the flow chamber 122. This results in a sharp system pressure drop. The annular clearance 118 may be designed such that the system pressure drops below the needle closing pressure. If so, the needle valve 80 falls back to its seat resulting in an initial pilot injection of a small quantity of fuel into the combustion chamber of the engine.

Meanwhile, the plunger 18 continues its downward movement and the needle valve 80 opens again after the system pressure has once again reached the needle opening pressure. However, the rate shaping valve 100 remains open even during the initial pressure drop because the pressure required to keep it open is less than required to initially open the rate shaping valve.

Figure 8:
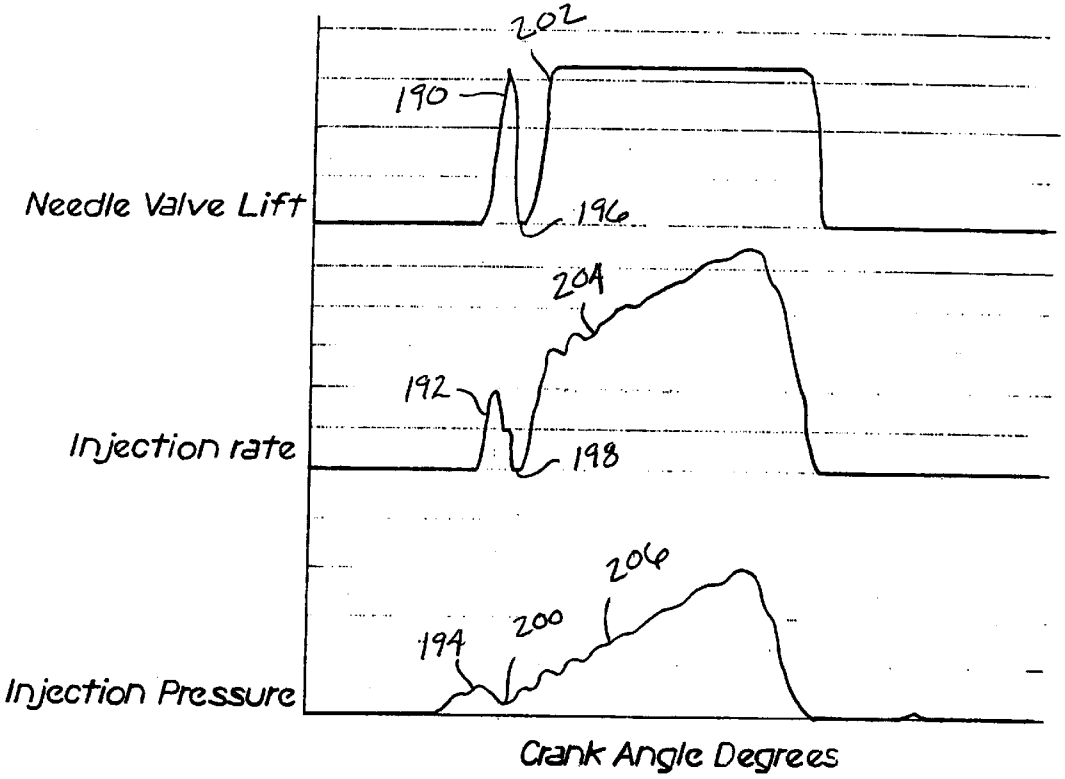
FIG. 8 is a graph of the needle valve lift, injection rate and injection pressure over the movement of the crank angle in degrees.
Figure 6:
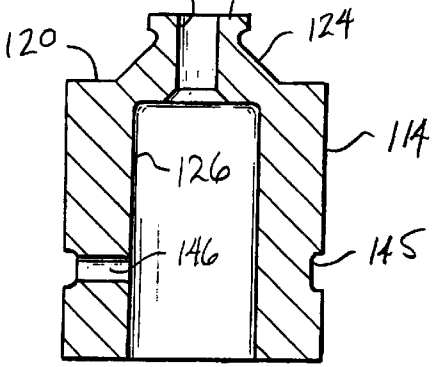
FIG. 6 is a cross-sectional side view of the rate shaping valve member of the present invention.
Figure 7:
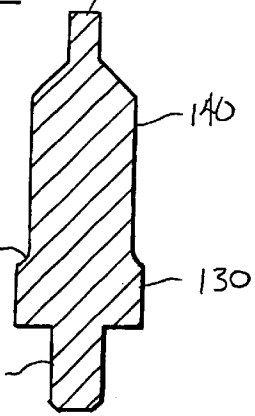
FIG. 7 is a cross-sectional side view of the waste gate valve member of the present invention.

The pilot injection scenario discussed above is illustrated graphically in FIG. 8. There, initial needle valve movement is indicated at 190. This causes an initial rate of fuel injection at the beginning of the injection event as indicated at 192. Similarly, the injection pressure initially rises as indicated at 194. However, the needle valve 80 is then closed when the rate shaping valve 100 initially opens as indicated at 196. The injection rate drops to 0 as indicated at 198 and the injection pressure dips as indicated at 200. After the system pressure has again risen to the predetermined needle opening pressure, the needle valve 80 is then opened as indicated at 202, and the injection rate and injection pressure rises, as indicated at 204 and 206, respectively.

Figure 9:
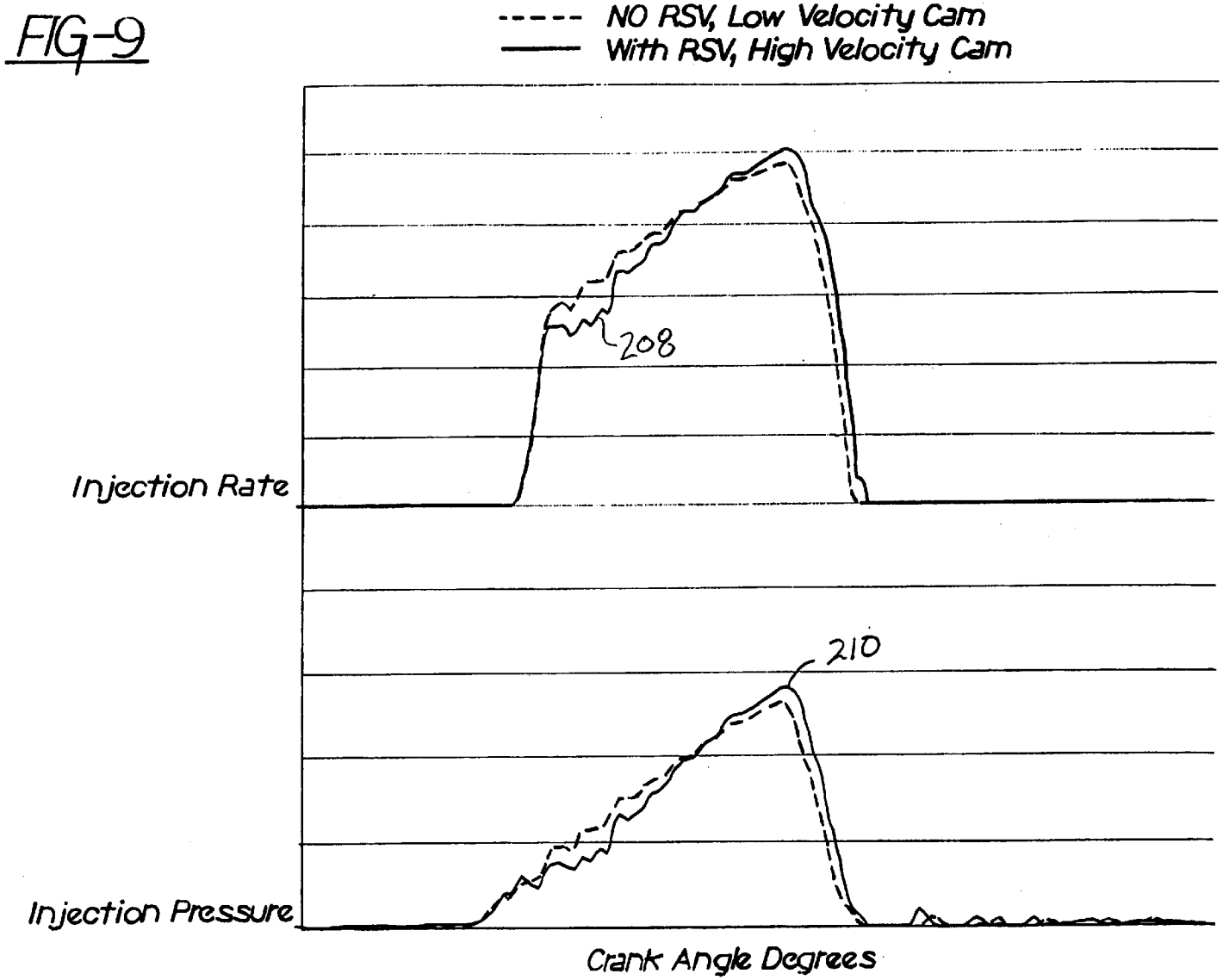
FIG. 9 is a comparison of the injection rate and injection pressure versus the crank angle in degrees of a fuel injector with and without a rate shaping valve of the present invention.

Alternatively, a smaller annular clearance 118 provides fuel flow at a lower rate to the valve chamber 122. This results in less of an injection pressure drop than illustrated in FIG. 8. Moreover, the annular clearance 118 and the lift "$L_1$" of the rate shaping valve 100 may be engineered such that there is no pilot injection, but rather the overall initial injection rate is merely reduce. This feature is graphically illustrated in FIG. 9 where in the injection rate and the injection pressure of a fuel injector having a rate shaping valve 100 (shown in solid lines) is compared with one without a rate shaping valve (shown in dashed lines). The injector having a rate shaping valve 100 results in a lower injection rate as shown at 208 but a higher injection pressure as shown at 210 than that of the injector without a rate shaping valve. Thus, various combinations of initial injection rate shape can be created by modifying the geometry of the annular clearance 118 and the rate shaping valve lift "$L_1$" to provide for pilot injection, lower the initial rate of injection, yield lower maximum combustion temperatures and lower $NO_x$ emissions.

Where a high velocity injection cam is used or the diameter of the plunger is specified so as to generate high injection pressures at lower engine speed or load, the system pressures generated at high engine speed or high load may test the integrity of the injector, cause failure or lead to premature wear. Accordingly, the pressure regulator 60 of the present invention further includes the waste gate valve 102. In response to a predetermined, elevated system pressure, the waste gate valve body 130 moves to its open position over a distance indicated as $L_2$ in FIG. 4 and against the biasing force of the coiled spring 94 acting on the body 130 through its tail 152. The waste gate valve opening pressure is defined by the area "B" of the inlet 128 and the total load on the coil spring 94. This load is the sum of the initial spring load and the load due to the rate shape valve lift "$L_1$". Pressurized fuel then flows past the annular clearance 134 and into the waste fuel passage system 136. More specifically, the pressurized fuel flows via the grooved passages 138 through the shunt passages 146 to the annular groove 145 in the lower portion of the rate shaping valve body 114 and into the fuel spill gallery 72 via the connecting passage 144. The annular clearance 134 and the waste gate valve lift "$L_2$" define the spill rate of the pressurized fuel. The high pressure fuel delivery system 30 is thus vented to the low pressure spill gallery 72 resulting in a limitation of the maximum pressure which can be developed in the assembly 10.

Figure 10:
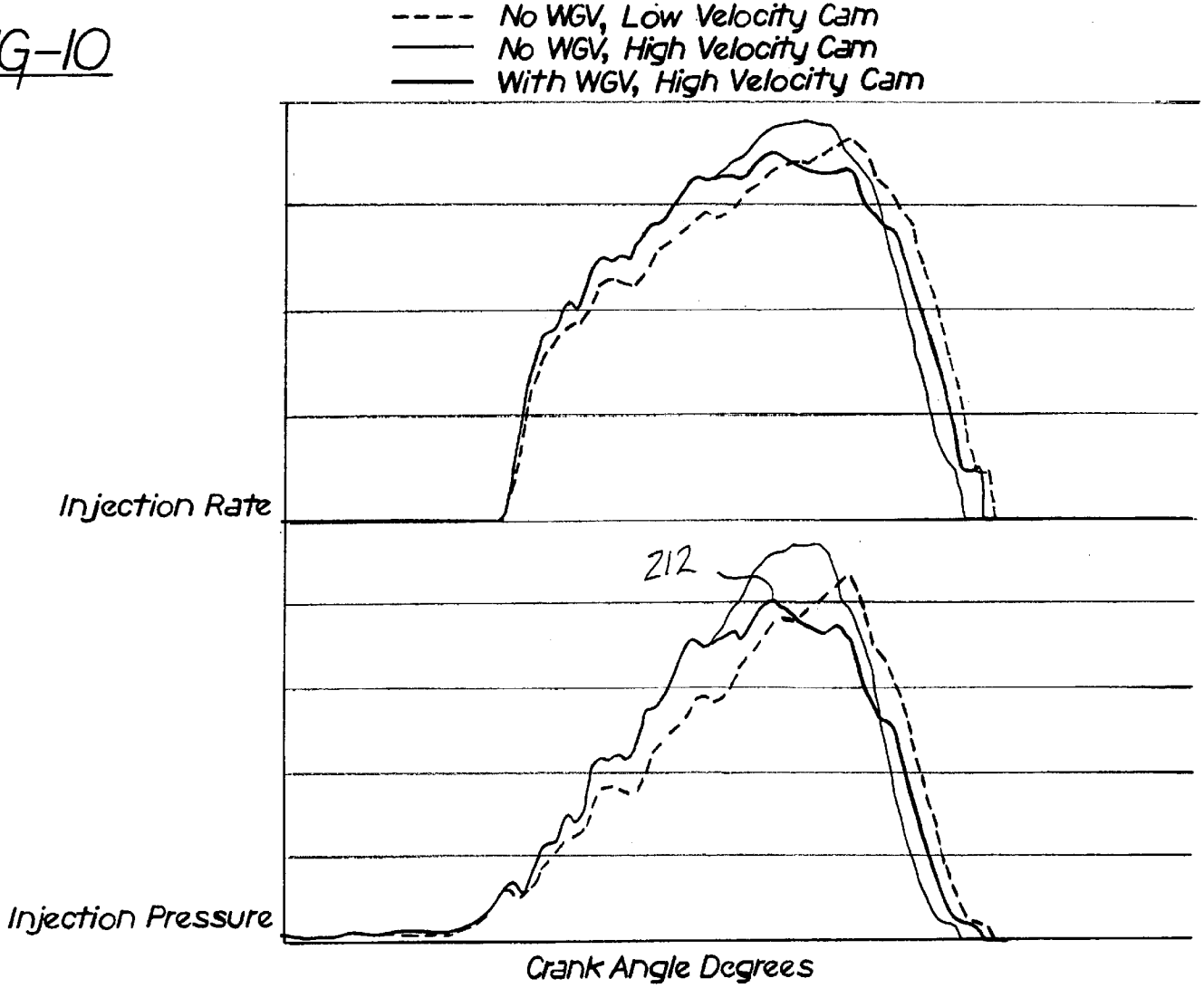
FIG. 10 is a graph comparing the injection rate and injection pressure over the movement of a crank angle in degrees of fuel injectors with and without waste gate valves of the present invention.

This feature is graphically illustrated in FIG. 10 where the injection rate and injection pressure of an injector having a waste gate valve 102 (shown in thick solid lines) is compared with two injectors without a waste gate valve (shown as a thin solid line and dashed lines). FIG. 10 shows the limited peak injection pressure 212 achieved where the waste gate valve is employed.

At the end of the injection event, the solenoid assembly 160 is de-energized, the valve member 158 is biased to its open position under the influence of the coiled spring 180 and the high pressure fuel delivery system 30 is completely vented to the low pressure fuel spill gallery 72. The needle valve 80 reseats under the influence of the coiled spring 94 and the process is repeated.

Accordingly, the fuel injector assembly 10 of the present invention provides for a combined initial injection and peak injection pressure regulator 60 which is operable to control the nozzle assembly 28 to regulate the rate of fuel injection at the beginning of an injection event. More specifically, the regulator 60 is operable to provide for an initial, pilot injection, and/or reduce the initial rate of fuel injection. Furthermore, the pressure regulator 60 may be tuned such that various combinations of initial injection rate shape can be created thereby lowering the maximum combustion temperature and lowering $NO_x$ emissions. In addition, the pressure regulator 60 is further operable to limit the maximum pressure of the fuel dispersed from the nozzle assembly 28. Thus, the pressure regulator is especially adapted for use in conjunction with injectors where high injection pressures are desired at lower engine speed and load. The pressure regulator 60 thus effectively addresses the issue of liability and durability in these environments. The above features and advantages are further achieved in a simple, cost-effective and efficient pressure regulator which is elegantly simple and not overly mechanically complex.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

We claim:

1. A fuel injector body for an internal combustion engine, comprising:

an injector body in fluid communication with a source of fuel;

a nozzle assembly through which fuel in dispersed from said fuel injector assembly during an injection event;

a high pressure fuel delivery system providing high pressure fuel to said nozzle assembly;

a combined initial injector and peak injection pressure regulator operable to control said nozzle assembly to regulate the rate of fuel injection at the beginning of an injection event and further operable to limit the maximum pressure of the fuel dispersed from said nozzle assembly; said injection pressure regulator movably between a closed position and a first open position which reduces the rate of fuel injection at the beginning of the injection event as well as a second open position which limits the maximum pressure of the fuel dispersed by the nozzle assembly; said injection pressure regulator including a housing having a valve bore in fluid communication with said fuel delivery system; said valve bore defining a first, larger diameter; said housing including an inlet defining a second, smaller diameter for fluid communication between said fuel system and said valve bore; said injection pressure regulator further including a rate shaping valve including a body complimentarily received within and movably supported within said valve bore; a pintle head adapted to be received in said inlet so as to define a predetermined annular clearance therebetween, and a annular shoulder formed between said body and said pintle head and defining a valve chamber between said annular shoulder and said valve bore; said regulator movable between a closed position and an open position which reduces the rate of fuel injected at the beginning of the injection event and a waste gate valve movably supported within said fuel injector assembly between a closed position and an open position to allow fuel to flow into said valve chamber which limits the maximum pressure of the fuel injected at the end of the injection event by reducing the pressure of the fuel at the beginning of the injection event;

a biasing member supported within said fuel injector assembly which biases said injection pressure regulator to its closed position with a predetermined force such that injection pressure regulator moves to its first open position only after the pressure in said fuel delivery system has reached a predetermined first opening pressure and such that said injection pressure regulator moves to its second open position only after the pressure in said fuel delivery system has reached a predetermined second opening pressure; and a solenoid and armature control valve assembly to control timing and fuel quantity during each fuel injection event.

2. An assembly as set forth in claim 1 wherein said biasing member biases said rate shaping valve to its closed position with a predetermined force such that said rate shaping valve moves to its open position only after the pressure in said fuel delivery system has reached a predetermined rate shaping valve opening pressure.

3. An assembly as set forth in claim 1 wherein said housing includes a valve seat defined between said inlet and said valve bore, said rate shaping valve including a frustoconical portion formed between said pintle head and said annular shoulder which cooperates with said valve seat when said rate shaping valve is in its closed position.

4. An assembly as set forth in claim 1 wherein said rate shaping valve defines a housing having a waste valve bore in fluid communication with said fuel delivery system;

said waste gate valve movably supported within said waste valve bore from a closed position to an open position in response to fuel pressure in said fuel delivery system to limit the maximum pressure of the fuel injected at the end of the injection event.

5. An assembly as set forth in claim 4 wherein said fuel injection assembly includes a fuel spill gallery through which unused fuel may be returned to said source of fuel;

said waste gate valve providing fluid communication between said fuel delivery system and said fuel spill gallery when said waste gate valve is in its open position.

6. An assembly as set forth in claim 5 wherein said waste valve bore defines a first, larger diameter, said waste gate housing includes an inlet defining a second, smaller diameter, said inlet providing fluid communication between said fuel delivery system and said waste valve bore;

said waste gate valve including a body complementarily received within said waste valve bore, a pintle head which is adapted to be received within said inlet so as to define a predetermined annular clearance therebetween and a waste fuel passage system providing fluid communication between said waste valve bore and said fuel spill gallery.

7. An assembly as set forth in claim 6 wherein said waste fuel passage system includes grooved passages formed on said waste gate valve body, at least one connecting passage extending through said injection pressure regulator housing and providing fluid communication between said fuel spill gallery and said rate shaping valve bore, and at least one shunt passage extending through said waste gate housing corresponding to said at least one connecting passage and providing fluid communication between said connecting passage and said grooved passages.

8. An assembly as set forth in claim 7 wherein said grooved passages include a plurality of flow grooves spaced circumferentially from one another about said waste body and extending axially along a portion thereof and a belt groove disposed annularly about the circumference of said waste body and establishing fluid communication with said flow grooves as well as said shunt passage.

9. An assembly as set forth in claim 6 wherein said fuel nozzle assembly includes a nozzle tip having at least one aperture through which fluid is dispensed from said assembly, a nozzle bore in fluid communication with said fuel delivery system and a needle valve movably supported within said nozzle bore in response to fuel pressure between a closed position, wherein no fuel is dispersed from said nozzle assembly and an open position wherein fuel is dispersed from said nozzle tip through said at least one aperture when pressure in said nozzle bore exceeds a predetermined needle opening pressure.

10. An assembly as set forth in claim 9 wherein said nozzle bore defines an injection cavity which is in fluid communication with said fuel delivery system, said needle valve including a tip portion which is adapted to close said at least one aperture in said nozzle tip when the pressure in said fuel delivery system is below said needle closing pressure and a valve portion complementarily received within said injection cavity, said needle valve responsive to pressure acting on said valve portion to move to its open position when said fuel pressure exceeds said needle opening pressure.

11. An assembly as set forth in claim 9 further including a biasing member biasing said needle valve to its closed position with a predetermined force such that said needle valve moves to its open position only after the pressure in said fuel delivery system has reached said needle opening pressure.

12. An assembly as set forth in claim 11 wherein said biasing member includes a spring cage having a spring chamber formed therein, an upper retainer, a lower retainer and a coiled spring extending between said upper and lower spring retainers so as to bias said retainers with a predetermined force in opposite directions.

13. An assembly as set forth in claim 12 wherein said upper spring retainer translates said predetermined force to said injection pressure regulator to bias said regulator to its closed position.

14. An assembly as set forth in claim 12 wherein said spring chamber includes an upper aperture corresponding to said upper retainer, extending between said spring chamber and said waste valve bore, said waste gate valve body including a tail received through said upper aperture and engaged by said upper retainer, said predetermined force acting on said injection pressure regulator through said waste gate tail.

15. An assembly as set forth in claim 12 wherein said lower spring retainer translates said predetermined force to said needle valve to bias said needle valve to its closed position.

16. An assembly as set forth in claim 12 wherein said spring cage includes a lower aperture corresponding to said lower retainer and extending between said spring chamber and said nozzle bore, said needle valve including a head disposed opposite said tip portion, said head received through said lower aperture and engaged by said lower retainer, said predetermined force acting on said needle valve through said head.

17. An assembly as set forth in claim 12, wherein a solenoid is placed below plunger chamber; the assembly of armature and control valve is below the solenoid; and the flow passages from said high pressure chamber to said fuel spill gallery are very short to achieve a better control of control valve open-close end results in a better control of fuel injection event.

* * * * *